United States Patent [19]

Schambeck

[11] 4,114,219

[45] Sep. 19, 1978

[54] LONGITUDINALLY DISPLACEABLE CONNECTION FOR CANTILEVERED BEAM-TYPE STRUCTURAL PARTS

[75] Inventor: Herbert Schambeck, Frieding b. Herrsching, Germany

[73] Assignee: Dyckerhoff & Widmann AG, Munich, Germany

[21] Appl. No.: 817,504

[22] Filed: Jul. 20, 1977

[30] Foreign Application Priority Data

Jul. 27, 1976 [DE] Fed. Rep. of Germany ..... 2633668

[51] Int. Cl.[2] ..... E01D 19/06

[52] U.S. Cl. ..... 14/16.1; 14/1; 404/56

[58] Field of Search ..... 14/1, 16.1, 14, 17; 404/50, 51, 56, 61; 52/174

[56] References Cited

U.S. PATENT DOCUMENTS

| | | | |
|---|---|---|---|
| 279,927 | 6/1883 | Emery | 14/16.1 |
| 1,735,270 | 11/1929 | Fischer | 404/57 |
| 2,187,912 | 1/1940 | Peirce | 404/56 |
| 2,308,677 | 1/1943 | Dailey | 404/60 |
| 2,509,180 | 5/1950 | Yeoman | 404/57 |
| 2,712,750 | 7/1955 | Finsterwalder | 52/174 X |
| 3,160,900 | 12/1964 | Sedlacek | 14/17 X |

*Primary Examiner*—Nile C. Byers

*Attorney, Agent, or Firm*—Toren, McGeady and Stanger

[57] ABSTRACT

A pair of longitudinally extending cantilevered beam-type structural members are interconnected for the transmission of shearing forces between them. A part is secured to and projects longitudinally from the cantilevered end of one of the structural members into a horizontally displaceable bearing in the other. A reinforcing part is rigidly connected to one of the structural members and extends in the longitudinal direction of the structural member from its cantilevered end into and is supported by at least one longitudinally displaceable bearing in the other said structural member. The reinforcing part can be a single element or a pair of elements with one being a compression element and the other a tension element.

9 Claims, 11 Drawing Figures

LONGITUDINALLY DISPLACEABLE CONNECTION FOR CANTILEVERED BEAM-TYPE STRUCTURAL PARTS

SUMMARY OF THE INVENTION

The present invention is directed to a longitudinally displaceable connection between the adjacent ends of two serially arranged beam-type structural members, particularly, beam girders stressed for bending, and, more particularly, the invention concerns a reinforcing part extending from one structural member into the other and supported in one of them in a horizontally displaceable bearing. The connection is suitable for transmitting bearing forces.

In massive structures of reinforced concrete or prestressed concrete used in bridge systems, it is advantageous where the superstructures consist of cantilevered beam-type structural members formed monolithically with the piers, for the cantilevered ends to be interconnected in a longitudinally displaceable joint which is suitable for the transmission of shearing forces. In such bridge systems, the supporting behavior adapts itself in the construction operations in a particularly favorable manner to the supporting behavior in the normal use condition, and the super-structures, such as roadways, can be produced with very economical construction methods, that is, using free projections.

One disadvantage of this type of bridge system is that deflections develop, due to the creep and shrinkage in the range of the joint connecting the structural parts which deflections are much greater than in a continuous girder without joints and a break may be caused in the roadway gradient. Another disadvantage occurs when positive and negative shearing forces occur in the joint and exactly fitted double bearings must be utilized which are unloaded under constant loads and suffer considerable repetitive stresses under the load of traffic. Moreover, there is the risk that the bearings might jam during longitudinal member movements caused by temperature changes.

Therefore, the primary object of the present invention is to avoid or at least reduce the increased deflections at the interconnected ends of the structural members and also to avoid any break in the roadway gradient at the location of the joint, particularly any break caused by creep or shrinkage.

In accordance with the present invention, a longitudinally displaceable connection is provided including a reinforcing part for absorbing both compression and tension forces with the reinforcing part being rigidly connected into one of the structural members and extending in its longitudinal direction into the adjacent end of the other structural member where it rests in at least one horizontally displaceable bearing suitable for transmitting shearing forces. In a preferred arrangement, the reinforcing part can be formed of two elements, a compression element and a tension element with the two elements forming two sides of a triangular truss.

One particular advantage of the invention occurs not only when external stresses appear but also when deformations occur in the two structural members due to creep and shrinkage, temperature differences, settlement of the supporting members, and the like, with a bending moment being introduced into the two interconnected structural members without interfering with the horizontal mobility of the joint or with the transmission of the shearing forces in the vertical and horizontal directions. The bending line of a bridge structure equipped with such a connection approaches the bending line of a continuous girder, accordingly, no break appears in the roadway gradient.

For the introduction of bending moments into the interconnected structural members, the reinforcing part is preferably prestressed by external forces and such prestressing can be effected by shortening the tension element, or by raising the bearing for the reinforcing part. In this way, a predetermined force and a predetermined bending moment can be introduced into the two structural members for the "dead load" condition. Furthermore, the arrangement of the interconnection is such that the horizontally displaceable bearings are prestressed under dead loads so that the bearing forces including traffic loads in unfavorable positions, are such that the complicated double bearings for receiving positive and negative transverse forces, such as needed in conventional joints, can be replaced by regular thrust bearings.

Where the reinforcing part consists of at least two elements, the tension element can be elastically extensible or the bearing for the reinforcing part can be made elastically compressible. This has the effect that the reinforcing part, which is prestressed in a predetermined manner for the "dead load" condition, is only slightly stressed under the "traffic load" condition. The construction cost of the bridge structure is improved and the repetitive stresses on the bearing due to traffic loads is kept at a minimum.

Preferably, the compression element of the reinforcing part is formed as a reinforced concrete deck in a bridge structure having at least two longitudinal girders. The reinforced concrete deck is provided advantageously with a joint.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
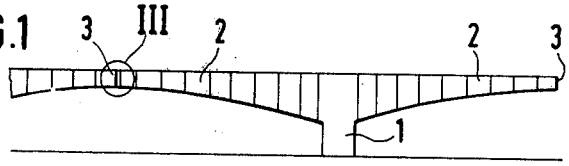
FIG.1 PRIOR ART
FIGS. 1 and 1*a* are side elevations of a bridge structure with cantilevered beam-like structural members extending from a pier or abutment.
Figure 1A:
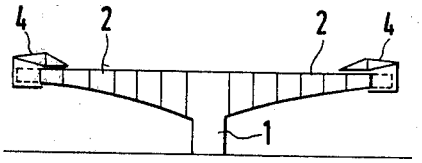
FIG.1a PRIOR ART
Figure 2:
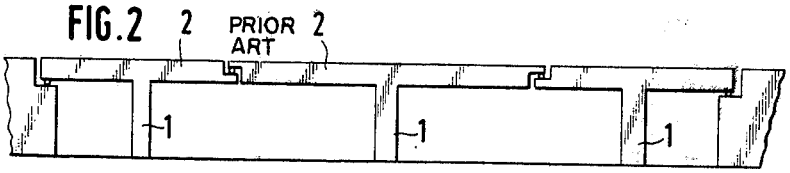
FIG.2 PRIOR ART
FIG. 2 is a side elevation of another bridge-type supporting structure.

The present invention is applicable primarily for use in bridge-type structures, such as shown in FIGS. 1, 1*a* and 2. In such bridge-type structures, generally horizontally extending cantilever members 2 are formed monolithically with a pier or abutment 1 and project outwardly from the pier and are interconnected at the cantilevered ends 3,3'. The joint at the interconnection of the cantilevered ends 3,3' is arranged for absorbing horizontal movements due to temperature changes and also for the transmission forces. Such bridge-type structures can be produced very advantageously in sections in free projection by means of projecting concreting scaffolding or form work, as indicated in FIG. 1*a*.

Figure 3:
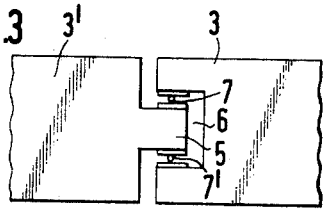
FIG.3 PRIOR ART
FIG. 3 is an enlarged detail view of the joint in the circle III in FIG. 1 which corresponds to the state of the art.

In FIG. 3 a known embodiment of a joint for interconnecting the cantilevered ends 3,3' of two structural members is illustrated schematically. One of the cantilevered ends 3' has a bracket 5 extending in the longitudinal direction of the member into a corresponding recess 6 in the cantilivered end 3 of the other structural member 3. The bracket 5 is usually a horizontal projection from a vertical or near-vertical surface and is used to support a load. Located above and below the bracket 5 are horizontally displaceable bearings 7,7' of conventional design, so that positive and negative shearing forces can be transmitted through this interconnected arrangement with free horizontal mobility.

Figure 4:
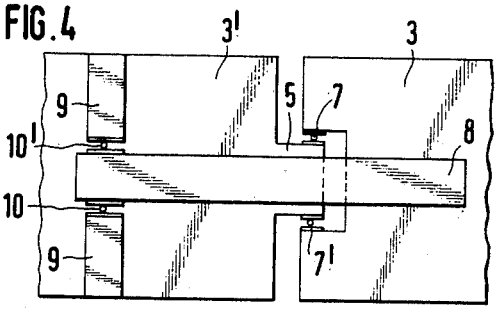
FIG. 4 is a schematic side elevation representing a joint embodying the present invention and utilizing a rod-shaped reinforcing part.

In FIGS. 4-7 several embodiments of a connection embodying the present invention are shown schematically. In FIG. 4, in addition to the bracket 5 rigidly connected to the cantilevered end 3' of one of the structural members, a bending-resistant reinforcing part 8 is rigidly connected to the cantilevered end 3 of the other structural member and extends in the longitudinal direction of the longitudinal parts into the juxtaposed end 3 of the one structural member. Within the cantilevered end 3', reinforcing part 8 is mounted between two brackets 9 and horizontally displaceable bearings 10,10'. For reasons of symmetry, this arrangement can be provided on both sides of the joint in the cantilevered ends 3,3' of the structural members. With the full transmission of the shearing forces and the assurance of the horizontal displaceability, in this arrangement bending moments can be introduced into the structural members.

Figure 5:
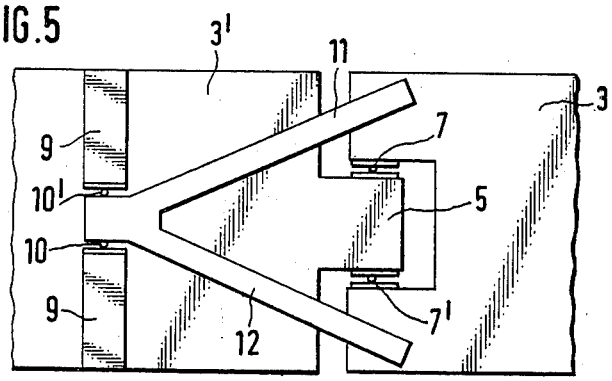
FIG. 5 is a schematic side elevation representing a joint embodying the present invention where the reinforcing part is arranged as two sides of a triangular truss.

In the embodiment displayed schematically in FIG. 5, the reinforcing part 8 is arranged in the form of two sides of a triangular truss with a compression element 11 and a tension element 12. The right hand ends of the compression element 11 and the tension element 12 are secured in spaced relation to one another within the cantilevered end 3 of one structural member and the opposite or left hand ends of the compression element 11 and the tension element 12 are interconnected and positioned between the horizontally displaceable bearings 10, 10' which are supported by the brackets 9,9'. The compression element 11 and the tension element 12 are spaced angularly apart from one another as they extend from the left hand to the right hand ends, note FIG. 5. This arrangement can be provided in both sides of the joint interconnecting the cantilevered ends 3,3' of the structural members.

Figure 6:
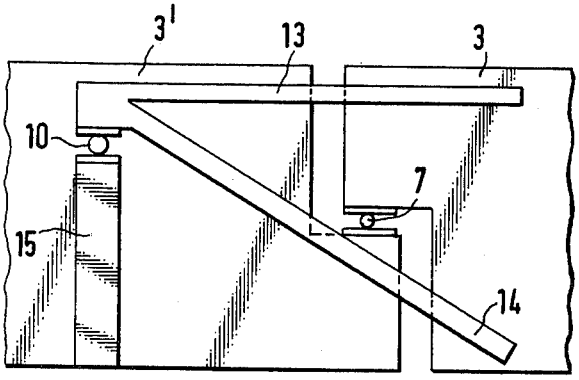
FIG. 6 is another schematic side elevation representing a joint embodying the present invention where the tension element of the reinforcing part is prestressed.
Figure 7:
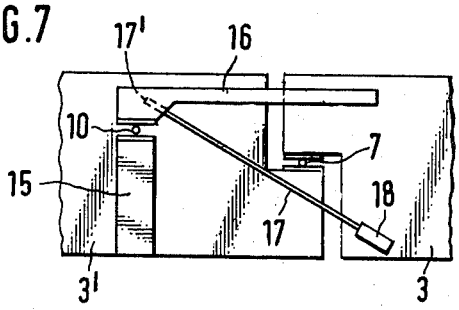
FIG. 7 is a schematic side elevation representing another embodiment of the joint incorporating the present invention where the tension element is elastically extensible.

Another embodiment of the interconnection incorporating the present invention is shown in FIG. 6. In this arrangement, upper compression member 13 extends horizontally while the tension element 14 is connected to the compression element at the left hand end as shown in FIG. 6 and extends angularly downwardly from the compression element as it extends from the cantilevered end 3' of one structural member into the cantilevered end 3 of the other structural member. By shortening the tension element 14 due to an initial stress, a vertical force component is developed which exerts a vertical pressure on the bearings 7,10. As a result, bearings 7' and 10' as in FIGS. 4 and 5, which are only stressed under shearing forces of the opposite sign, can be eliminated. The pressure on bearings 7 and 10 can be produced inversely by raising bearing 10 and this can be done by the installation of a hydraulic press in the cantilevered end 3' of the one structural member. A particularly advantageous embodiment of the invention is shown in FIG. 7. The embodiment of FIG. 7 corresponds substantially to that shown in FIG. 6. Compression element 16 is clamped within the cantilevered end 3 of structural member 3 and it extends longitudinally into the cantilevered end of the other structural member 3' where it rests on a bearing 10 supported on a bracket 15. Tension element 17 is formed as an elastic bar in the sense of a soft spring, it is connected to the compression element 16 at the system center 17' and from that point extends downwardly at an angle to the compression element 16 into the cantilevered end 3 of wherein it is secured to an anchor 18. Preferably, tension member 17 consists of conventional clamping elements, for example, threaded ties which are protected against corrosion. In this manner, a certain tensile force can be introduced into the tension element so that bending moments are provided in structural member of cantilevered end 3 by a horizontal force couple and in the structural member of cantilevered 3' by a vertical force couple. It is also possible to retighten tension element 17, if necessary, to change or correct the tensile force and thus also bending moments. The same effect can be achieved in this arrangement as mentioned in the previous embodiment if the bearing 10 for the reinforcing part is made elastically compressible.

Figure 8:
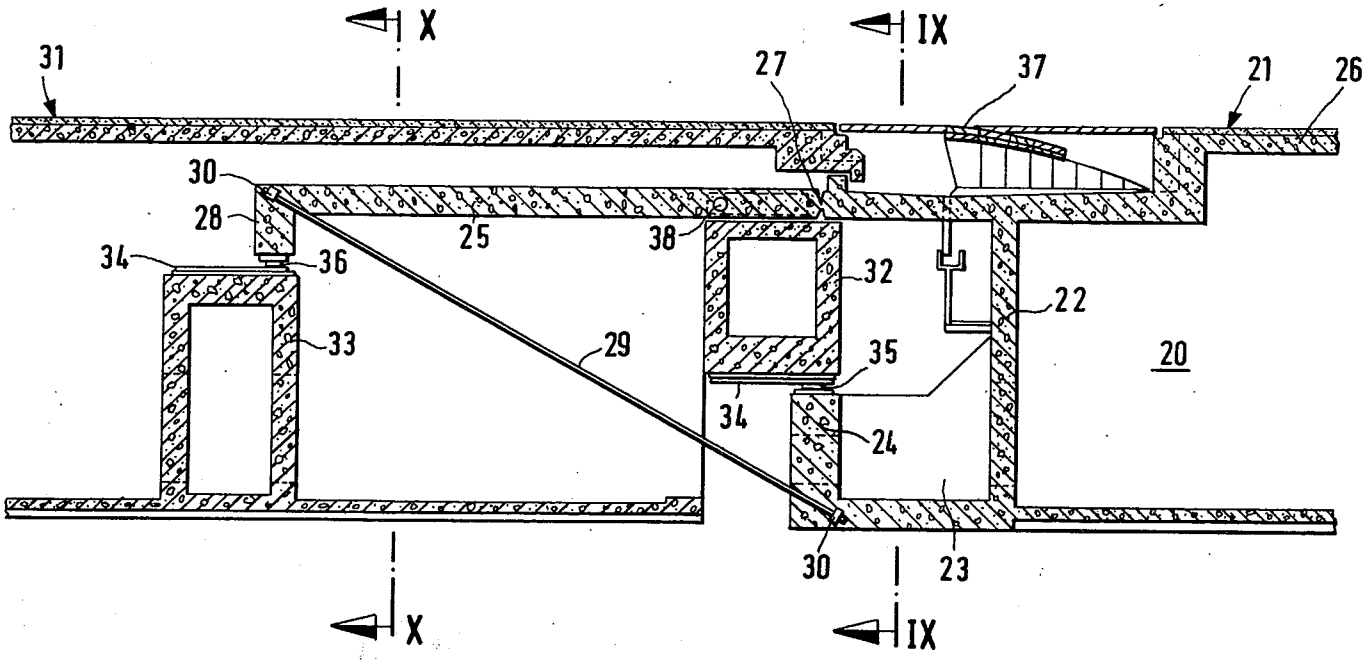
FIG. 8 is a detailed longitudinal section through another embodiment of the invention taken along the lines VIII—VIII in FIGS. 9 and 10.
Figure 9:
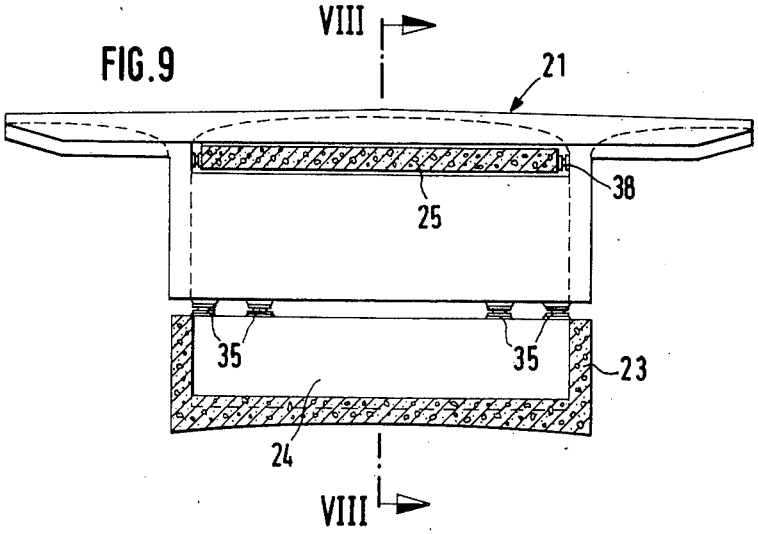
FIG. 9 is a cross-sectional view taken along the line IX—IX in FIG. 8.
Figure 10:
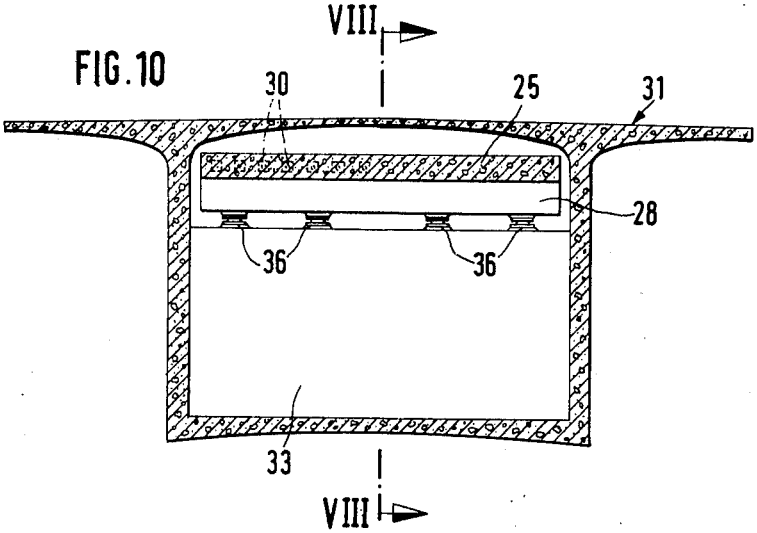
FIG. 10 is a cross-sectional view taken along the line X—X in FIG. 8.

While the embodiments illustrated in FIGS. 4-7 are merely schematic representations of the essential part of the articulated interconnection according to the invention, the interconnection can be adapted to the special constructional conditions experienced in various support structures, and FIGS. 8-10 show a specific embodiment of the invention in a bridge structure where the superstructure consists of a hollow box section.

A girder stem 20 of one superstructure part 21 extends beyond a vertical end wall 22 in the form of a bracket 23 which terminates in a front wall 24. The reinforcing part consists of a compression element in the form of a reinforced concrete deck 25 and extends from a downwardly extending shoulder of the roadway deck 26 of superstructure part 21. The reinforced concrete deck 25 includes, on the side adjacent the superstructure part 21, a reinforced concrete joint 27 and at its opposite end within the superstructure part 31 it is shaped as a supporting girder 28. Deck 25 serves at the same time to accommodate the necessary guide bearing 38 for horizontal forces directed transversely of the bridge-type structure.

The tension element of the reinforcing part consists in this case of a number of steel bars 29 anchored at their upper ends to anchor 30 in the supporting girder 28 and at their lower ends to anchors 30 within the front wall 24.

The other superstructure part 31 has at its end closest to the superstructure part 21 an upper traverse member 32 in the form of a box and a rear traverse member 33 also formed as a box. The lower surface of the upper traverse member 32 and the upper surface of the rear traverse member 33 each have a slideway 34 in contact with slide bearings 35, 36, respectively. The slide bearing 35 is mounted on the upper end of the front wall 24 and the other slide bearing 36 is mounted on the lower end of the supporting girder 28.

The design of the interconnection of the superstructure parts 21 and 31 is completed by a transition construction 37 designed in the known conventional manner.

While specific embodiments of the invention have been shown and described in detail to illustrate the application of the inventive principles, it will be understood that the invention may be embodied otherwise without departing from such principles.

What is claimed is:

1. A longitudinally displaceable connection comprising a pair of generally horizontally arranged longitudinally extending cantilevered beam-type structural members with structural members disposed in longitudinal alignment and each having a cantilevered end with said cantilevered ends disposed in juxtaposed relation, a horizontally arranged projecting part secured to and extending outwardly from the cantilevered end of one of said structural members into the cantilevered end of the other one of said structural members, a first horizontally displaceable bearing in the cantilevered end of the other one of said structural members and said first bearing supporting said projecting parts, said projecting part and said first bearing arranged for the transmission of shear forces, wherein the improvement comprises a reinforcing part separate from said projecting part and rigidly connected to one of said structural members and extending outwardly in the longitudinal direction thereof from the cantilevered end thereof into the cantilevered end of the other one of said structural members, and at least one second horizontally displaceable bearing separate from said projecting part and said first bearing and said second bearing located in the other one of said structural members into which said reinforcing part extends and affording a bearing support for said reinforcing part spaced longitudinally from said first bearing and said second bearing being suitable for the transmission of shearing forces.

2. A longitudinally displaceable connection as set forth in claim 1, wherein said reinforcing part is formed of a compression element and a tension element with said elements each extending generally in the longitudinal direction of said structural members and each having a first end and a second end with the first ends spaced apart in said structural member within which said reinforcing part is rigidly connected and with the second ends of said elements located in the other said structural member and interconnected with said compyession element and tension element forming two sides of a triangular shaped truss.

3. A longitudinally displaceable connection, as set forth in claim 2, wherein said reinforcing part is prestressed by entering external forces therein for the introduction of bending moments into said structural members.

4. A longitudinally displaceable connection, as set forth in claim 3, wherein said tension element is shortened by the application of initial stress.

5. A longitudinally displaceable connection, as set forth in claim 3, wherein said second bearing for said reinforcing part is vertically displaceable.

6. A longitudinally displaceable connection, as set forth in claim 3, wherein said tension element is elastically extensible.

7. A longitudinally displaceable connection, as set forth in claim 3, wherein said second bearing for said reinforcing part is elastically compressible.

8. A longitudinally displaceable connection, as set forth in claim 3, wherein said structural members comprise at least two longitudinally extending girders, with the compression element of said reinforcing part formed as a reinforced concrete deck.

9. A longitudinally displaceable connection, as set forth in claim 8, wherein said reinforced concrete deck has a joint therein, said joint located intermediate the longitudinally spaced ends of said deck and positioned in the range of the joint interconnecting said structural members.

* * * * *